US007887758B2

(12) United States Patent
Ostgaard et al.

(10) Patent No.: US 7,887,758 B2
(45) Date of Patent: Feb. 15, 2011

(54) SAMPLE VIAL FOR USE IN PREPARING CYTOLOGICAL SPECIMEN

(75) Inventors: Roy A. Ostgaard, Bolton, MA (US); Edward J. O'Connell, Chelmsford, MA (US); Mark J. Licari, Acton, MA (US)

(73) Assignee: Cytyc Corporation, Marlborough, MA (US)

( * ) Notice: Subject to any disclaimer, the term of this patent is extended or adjusted under 35 U.S.C. 154(b) by 0 days.

(21) Appl. No.: 12/575,424

(22) Filed: Oct. 7, 2009

(65) Prior Publication Data

US 2010/0021343 A1 Jan. 28, 2010

Related U.S. Application Data

(63) Continuation of application No. 09/156,952, filed on Sep. 18, 1998.

(51) Int. Cl.
*B01L 9/00* (2006.01)

(52) U.S. Cl. ..... 422/104; 422/63; 422/65; 422/101; 422/102

(58) Field of Classification Search ..... 422/58, 422/63, 64, 65, 66, 67, 68.1, 101, 102, 104; 436/46, 47, 54, 174, 177, 178
See application file for complete search history.

(56) References Cited

U.S. PATENT DOCUMENTS

| | | | |
|---|---|---|---|
| 2,739,564 | A | 3/1956 | North |
| D179,206 | S | 11/1956 | Lynn |
| 3,107,805 | A | 10/1963 | Asher |
| D225,161 | S | 11/1972 | Ritchie |
| 3,733,001 | A | 5/1973 | Gach |
| 3,825,143 | A | 7/1974 | Julian |
| 3,828,961 | A | 8/1974 | Lewis |
| 3,898,046 | A | 8/1975 | Ikeda et al. |
| D244,555 | S | 5/1977 | Wiedmann |
| 4,234,539 | A | 11/1980 | Ginsberg et al. |
| 4,430,299 | A | 2/1984 | Horne |
| 4,639,242 | A | 1/1987 | Babson |
| 4,705,630 | A | 11/1987 | Gordon et al. |
| 4,733,773 | A | 3/1988 | LaBianca et al. |
| 4,799,598 | A | 1/1989 | McFadyen |
| 4,832,917 | A | 5/1989 | Elliott |
| 4,855,110 | A | 8/1989 | Marker et al. |
| 4,859,610 | A | 8/1989 | Maggio |
| 4,872,563 | A | 10/1989 | Warder et al. |
| 4,874,582 | A | 10/1989 | Gordon et al. |
| 4,904,450 | A | 2/1990 | Floyd |
| 4,915,255 | A | 4/1990 | Curtis |
| 4,917,867 | A | 4/1990 | Jensen et al. |

(Continued)

FOREIGN PATENT DOCUMENTS

| | | |
|---|---|---|
| EP | 0417006 | 3/1991 |

(Continued)

OTHER PUBLICATIONS

Cytyc Corporation, ThinPrep® 2000 Operator's Manual (1995).

*Primary Examiner*—Jill Warden
*Assistant Examiner*—Dwayne K Handy
(74) *Attorney, Agent, or Firm*—Vista IP Law Group LLP

(57) ABSTRACT

A sample vial is disclosed for use in conjunction with an automated cytological specimen preparation system.

12 Claims, 2 Drawing Sheets

U.S. PATENT DOCUMENTS

| | | | |
|---|---|---|---|
| D310,264 | S | 8/1990 | Leoncavallo et al. |
| 4,976,923 | A | 12/1990 | Lipsky et al. |
| 5,039,615 | A | 8/1991 | Takahata |
| 5,075,079 | A | 12/1991 | Kerr et al. |
| 5,081,038 | A | 1/1992 | Sugaya et al. |
| 5,089,229 | A | 2/1992 | Heidt et al. |
| 5,094,816 | A | 3/1992 | Ishizaka et al. |
| 5,143,627 | A | 9/1992 | Lapidus et al. |
| 5,151,184 | A | 9/1992 | Ferkany |
| 5,164,575 | A | 11/1992 | Neeley et al. |
| 5,209,903 | A | 5/1993 | Kanamori et al. |
| 5,232,111 | A | 8/1993 | Burns |
| 5,240,606 | A | 8/1993 | Lapidus et al. |
| 5,256,571 | A | 10/1993 | Hurley et al. |
| 5,262,049 | A | 11/1993 | Ferkany |
| 5,269,918 | A | 12/1993 | Lapidus et al. |
| 5,273,905 | A | 12/1993 | Muller et al. |
| 5,282,978 | A | 2/1994 | Polk, Jr. et al. |
| 5,336,467 | A | 8/1994 | Heidt et al. |
| 5,356,595 | A | 10/1994 | Kanamori et al. |
| 5,374,395 | A | 12/1994 | Robinson et al. |
| 5,429,803 | A | 7/1995 | Guirguis |
| 5,439,649 | A | 8/1995 | Tseung et al. |
| 5,460,778 | A | 10/1995 | Macindoe, Jr. |
| 5,494,170 | A | 2/1996 | Burns |
| 5,518,688 | A | 5/1996 | Gianino |
| 5,589,400 | A | 12/1996 | Hayes |
| 5,595,707 | A | 1/1997 | Copeland et al. |
| 5,650,327 | A | 7/1997 | Copeland et al. |
| 5,654,199 | A | 8/1997 | Copeland et al. |
| 5,654,200 | A | 8/1997 | Copeland et al. |
| 5,670,329 | A | 9/1997 | Oberhardt |
| 5,676,910 | A | 10/1997 | Levine et al. |
| 5,690,242 | A | 11/1997 | Campbell, Jr. |
| 5,690,815 | A | 11/1997 | Krasnoff et al. |
| 5,854,075 | A | 12/1998 | Levine et al. |
| 5,855,289 | A | 1/1999 | Moore |
| 5,894,733 | A | 4/1999 | Brodner |
| 5,981,166 | A | 11/1999 | Mandecki |
| D420,744 | S | 2/2000 | Ostgaard et al. |
| 6,235,010 | B1 | 5/2001 | Wilkinson et al. |
| 6,309,362 | B1 * | 10/2001 | Guirguis ..... 600/573 |
| 6,319,470 | B1 | 11/2001 | Lefevre et al. |

FOREIGN PATENT DOCUMENTS

| | | |
|---|---|---|
| EP | 0508568 | 10/1992 |
| EP | 0740142 | 10/1996 |
| EP | 0984263 | 3/2000 |
| WO | WO 99/10723 | 3/1999 |
| WO | WO 99/49295 | 9/1999 |
| WO | WO 00/62035 | 10/2000 |

* cited by examiner

SAMPLE VIAL FOR USE IN PREPARING CYTOLOGICAL SPECIMEN

RELATED APPLICATION DATA

This application is a continuation application of co-pending U.S. patent application Ser. No. 09/156,952, filed Sep. 18, 1998, the priority of which is claimed under 35 U.S.C. §120, and the contents of which are incorporated herein by reference in their entirety, as though set forth in full.

FIELD OF THE INVENTION

This invention relates to apparatus for storing fluid samples adapted for use with an automated cytological specimen preparation system.

BACKGROUND OF THE INVENTION

Cytology is a branch of biology dealing with the study of the formation, structure, and function of cells. As applied in a laboratory setting, cytopathologists, cytotechnologists, and other medical professionals make medical diagnoses of a patient's condition based on visual examination of a specimen of the patient's cells. A typical cytological technique is a "pap smear" test, in which cells are scraped from a woman's cervix and analyzed in order to detect the presence of abnormal cells, a precursor to the onset of cervical cancer. Cytological techniques are also used to detect abnormal cells and disease in other parts of the human body.

Cytological techniques are widely employed because collection of cell samples for analysis is generally less invasive than traditional surgical pathological procedures such as biopsies, whereby a tissue specimen is excised from the patient using specialized biopsy needles having spring loaded translatable stylets, fixed cannulae, and the like. Cell samples may be obtained from the patient by a variety of techniques including, for example, by scraping or swabbing an area, or by using a needle to aspirate body fluids from the chest cavity, bladder, spinal canal, or other appropriate area. The cell samples are placed in solution and subsequently collected and transferred to a glass slide for viewing under magnification. Fixative and staining solutions may be applied to the cells on the glass slide for preserving the specimen for archival purposes and for facilitating examination.

It is generally desirable that the cells on the slide have a proper spatial distribution, so that individual cells can be examined. A single layer of cells is typically preferred. Accordingly, preparing a specimen from a fluid sample containing many cells typically requires that the cells first be separated from each other by mechanical dispersion, fluidic shear, or other techniques so that a thin, monolayer of cells can be collected and deposited on the slide. In this manner, the cytotechnologist can more readily discern abnormal cells. The cells are also able to be counted to ensure that an adequate number of cells have been evaluated.

Certain methods, apparatus, and materials for generating a thin monolayer of cells on a slide advantageous for visual examination are disclosed in U.S. Pat. No. 5,143,627 issued to Lapidus et al. and entitled "Method and Apparatus for Preparing Cells for Examination;" U.S. Pat. No. 5,240,606 issued to Lapidus et al. and entitled "Apparatus for Preparing Cells for Examination;" and U.S. Pat. No. 5,256,571 issued to Hurley et al. and entitled "Cell Preservative Solution," all of which are assigned to the assignee of the present invention and all of the disclosures of which are incorporated herein by reference in their entirety.

According to one method disclosed in these patents, a patient's cells in a preservative fluid in a sample container are dispersed using a spinning sample collector disposed therein. A controlled vacuum is applied to the sample collector to draw the fluid through a screen filter thereof until a desired quantity and spatial distribution of cells is collected against the filter. Thereafter, the sample collector is removed from the sample container and the filter portion impressed against a glass slide to transfer the collected cells to the slide in substantially the same spatial distribution as collected.

While apparatus manufactured according to the teachings of one or more of these patents have been commercially successful, such as the ThinPrep® 2000 System manufactured and sold by Cytyc Corporation located in Boxborough, Mass., such apparatus requires substantially constant attendance by a trained operator. For example, for each specimen to be prepared, the operator must load the system with an open sample vial containing the patient's cells in preservative fluid, a sample collector with filter, a glass slide, and an open fixative bath vial containing a fixative solution. The system then cycles automatically, the cells being dispersed by the sample collector, collected against the filter, and transferred to the slide. The slide is then automatically deposited in the fixative bath vial where it must be retrieved by the operator for manual loading in a staining rack for further processing. Thereafter, the sample vial and sample collector must be removed from the system, to avoid inter-sample contamination, before replacements and a new slide are installed to produce another specimen from a different patient's sample.

Once a specimen is prepared, fixed, and stained, the specimen may be manually visually inspected by a cytotechnologist, typically under magnification, and with or without various sources of illumination. Alternatively or additionally, automated machine vision systems have been adapted to aid cytological inspection. For example, an automated vision system may perform a preliminary assessment of the entire slide on which the specimen is disposed to alert the cytotechnologist to potentially the most relevant areas of the slide for close inspection, or may be used to rescreen specimens already analyzed by the cytotechnologist.

SUMMARY OF THE INVENTION

While automated specimen preparation systems such as those described hereinabove perform as designed, it is desirable to further reduce manual intervention required of the system operator so as to increase system throughput and operating efficiency. Accordingly, it is desirable to provide the capability wherein a plurality of sample vials, sample collectors with filters, and glass slides may be loaded in the system. The system then cycles automatically until all of the sample vials are processed and respective specimen slides produced. As a result, after initial loading, the system can operate unattended.

In one embodiment, the system may include a sample vial tray for loading of a plurality of closed, capped sample vial bodies. A sample vial transfer assembly retrieves serially each sample vial, unscrewing a cap thereof, and positioning the now open vial body in a position for cooperation with a sample collector and filter, which may be drawn automatically from another tray having a plurality of sample collectors. Once the cells are dispersed, either by the sample collector or rotation of the capped vial, the cells may be collected against the filter and transferred to a slide drawn automatically from a slide dispenser having a plurality of clean slides stored therein. The slide is then automatically deposited in a fixative bath vial for a period sufficient to fix the specimen on the slide. Alternatively, the fixative solution may be applied directly to the specimen on the slide by spraying with an air brush or similar technique. In either case, the slide may then be transferred to one of a number of multi-position staining racks previously loaded in the system, so that the fixative solution may dry. Once a first patient's specimen is prepared, the open sample vial body is recapped and replaced in the sample vial tray. The filter of the sample collector may be breached to prevent reuse and resultant inter-sample contamination. The next sample vial can then be retrieved and the specimen preparation method repeated until all of the sample vials are processed. Accordingly, once the system operator loads the sample vial tray, sample collector tray, slide dispenser, and staining racks and initiates the automatic sequence, the system can operate unattended.

In order to maintain the integrity of the specimens so produced, it is desirable to maintain one-to-one correlation between the contents of the sample vials and the respective specimens produced therefrom. When a cell sample is collected from a patient and deposited in the preservative fluid in the sample vial, creating cellular particles in a liquid suspension, the vial may be marked with unique identifying indicia corresponding to the type of sample, patient, date obtained, etc. In one embodiment, the identifying indicia may be a bar code label. When the sample vial is loaded into the system and retrieved from the sample vial tray by the sample vial transfer assembly, the indicia corresponding to the sample is identified. In the case of a bar code, a laser bar code scanner or charge coupled device scanner can be used.

In order that the system can prepare automatically cell specimens from fluid samples stored in a plurality of sample vials, each vial body and cap includes one or more structural features which facilitate grasping of the closed, capped vial by the sample vial transfer assembly, and removal and reinstallation of the cap. In one embodiment, the sample vial includes a body having a generally cylindrical outer surface, an open end, a closed end, and at least one lug disposed about an outer surface thereof. The lug performs an anti-rotation function, preventing the body from rotating when disposed against adjacent structure such as a vial tray or sleeve. Instead of a single anti-rotation lug, the body may include a plurality of circumferentially-disposed lugs and, in one embodiment, includes-six equi-spaced circumferentially-disposed lugs. While the lugs may be disposed anywhere on the body accessible to the sample vial transfer assembly or related structure of the system, in one embodiment the lugs are disposed proximate the open end of the body. The body may also include a flange proximate thereto.

The sample vial body may be manufactured from a substantially transparent or translucent material, for example a polypropylene material, so that a level of the fluid sample therein can be readily discerned by the system operator to ensure the presence of a sufficient amount of fluid for subsequent processing. The body may also include fluid level indicia disposed on the outer surface thereof, such as a circumferentially-disposed frosted annular band or one or more fill lines, and/or sample indicia disposed thereon, such as a bar code or a bar code label, so that the fluid sample contained therein can be uniquely identified.

The sample vial cap is releasably engagable with the body, for example by mating screw threads, and includes an outer surface with a torque pattern thereon for mating with a rotatable interface of the sample vial transfer assembly. The cap may be manufactured from a polypropylene material or other suitable material and may include knurling or other anti-slip feature along an outer perimeter thereof to facilitate manual handling by a clinician during sample procurement, as well as the system operator during manual loading and unloading of a system sample vial tray. In one embodiment, the cap torque pattern may be at least one generally radially disposed rib. In another embodiment, the torque pattern may be six generally radially disposed equi-spaced ribs.

A seal is disposed between the body and the cap so as to be capable of forming a substantially fluid-tight seal therebetween. The seal may be manufactured from a multicomposite material such as an elastomeric alloy disposed on a suitable vapor barrier. The seal may be free or may be disposed and retained within the cap. In one embodiment, a substantially fluid-tight seal between the body and the cap may be formed when between about 5 and 50 inch-pounds of torque is applied to the cap relative to the body. In one embodiment, the torque value may be about 20 inch-pounds. To ensure that a fluid-tight seal is produced when the patient's cells are first disposed in the preservative fluid and to prevent leakage or evaporation during transport and storage of the sample, each of the cap and the body may include an alignment marker, such that the alignment markers indicate a fluid-tight seal when at least aligned.

BRIEF DESCRIPTION OF THE DRAWINGS

The foregoing and other objects, features and advantages of the present invention, as well as the invention itself, will be more fully understood from the following description of exemplary and preferred embodiments, when read together with the accompanying drawings, in which.

DETAILED DESCRIPTION

The following examples are for illustrative purposes only, and should not be understood as limiting the scope of the invention, which is defined by the claims appended hereto. The present invention is related to the invention disclosed and claimed in the U.S. design patent application Ser. No. 29/093,806, filed on Sep. 18, 1998, now U.S. design patent number D420,744, the disclosure of which is incorporated herein by reference in its entirety.

A sample vial 10 adapted for use with an automated cytological specimen preparation system capable of preparing specimens from a plurality of patient samples in a substantially unattended manner includes structural features for mating with a vial transfer assembly of the automated system. These structural features facilitate grasping of the closed, capped vial 10 by the vial transfer assembly, as well as removal and reinstallation of a mating cap 14. These structural features may include at least one anti-rotation lug 18 on the outer surface of a body 12 of the sample vial 10.

Figure 1:
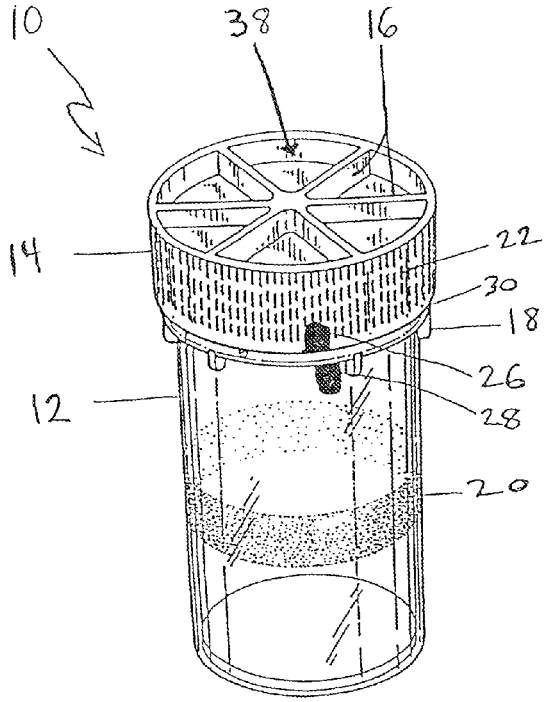
FIG. 1 is a schematic perspective view of a sample vial constructed in accordance with the teachings of the present invention depicting an assembled cap and body.
Figure 3:
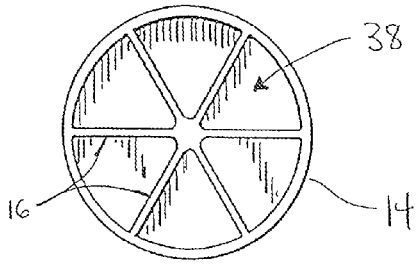
FIG. 3 is a schematic top view of the sample vial depicted in FIG. 1.

In one embodiment, depicted in FIG. 1, the vial body 12 includes six circumferentially disposed anti-rotation lugs 18, equi-spaced on an outer surface of the body 12. The anti-rotation lugs 18 are adapted for use with a storage tray and/or vial sleeve, as will be discussed in greater detail hereinbelow with respect to FIGS. 7A and 7B. The lugs 18 prevent rotation of the body 12, thereby facilitating automated removal and reinstallation of the cap 14. The lugs 18 may be disposed advantageously proximate an open end of the body 12, near the cap 14. In this manner, opposing torques may be applied to both the body 12 and the cap 14 at approximately the same axial plane, thereby minimizing any moment induced in the vial 10 during removal and reinstallation of the cap 14 which would tend to roll the vial 10. The vial 10 may also include a flange 30 proximate the lugs 18 which can be used, for example, as a datum surface so that the vial 10 can be repeatably positioned at a predetermined height in the storage tray and vial sleeve.

A torque pattern, shown generally at 38, is disposed on the outer surface of the cap 14. The torque pattern 38 includes at least one generally radially disposed rib 16 and may include, for example, six radially disposed, equi-spaced ribs 16, forming a pie-shaped pattern consisting of six sectors, as depicted in FIG. 1. The torque pattern 38 is adapted for use with the rotatable interface of the vial transfer assembly to facilitate removal and reinstallation of the cap 14, as will be discussed in greater detail hereinbelow with respect to FIG. 6. The ribs 16 also provide structural support to the cap 14, so that changes in internal pressure in the vial 10, for example due to increases in ambient temperature and evaporation of the preservative solution, minimize doming and the likelihood of leakage. The cap 14 may include knurling 22 or other friction enhancing feature disposed on its outer circumferential surface. The knurling 22 facilitates the manual removal and reinstallation of the cap 14, as well as gripping of the cap 14 or the capped vial 10 by the vial transfer assembly. The knurling 22 may include a series of closely-spaced, generally axially disposed ridges.

Figure 5:
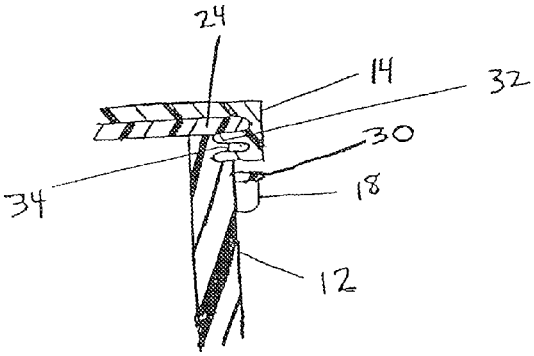
FIG. 5 is a schematic cutaway view of the sample vial depicted in FIG. 1.
Figure 4:
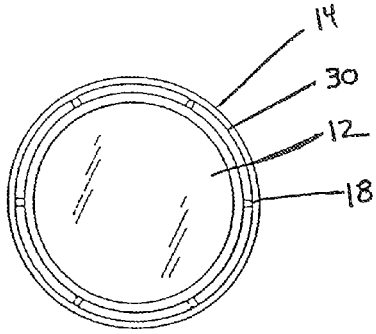
FIG. 4 is a schematic bottom view of the sample vial depicted in FIG. 1.

The sample vial 10 may also include structure for sealing, such as a compliant sealing flap molded in the cap 14 or a separate seal 24. As depicted in FIG. 5, the seal 24 is disposed and retained inside the cap 14. In this embodiment, depending on the pitch of mating cap and body screw threads 32, 34, the compliance of the seal 24, the durometer of the seal 24, and the thickness of the seal 24, the required torque to form a fluid-tight seal between the cap 14 and the body 12 can range from about 5 inch-pounds or less to about 50 inch-pounds or more. In one embodiment, a fluid-tight seal is formed between the seal 24 and the body 12 when approximately 25 inch-pounds of torque is required to be applied to the cap 14 relative to the body 12 to unscrew the cap 14.

Figure 2:
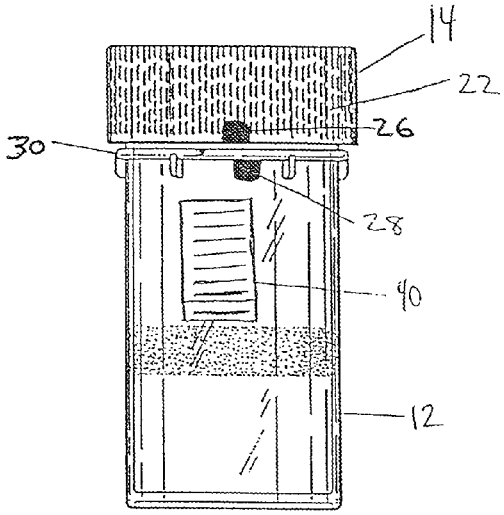
FIG. 2 is a schematic side view of the sample vial depicted in FIG. 1.

The cap 14 and the body 12 may advantageously include respective markers or marks 26, 28 that indicate a fluid-tight seal has been formed when the marks 26, 28 are at least aligned. As shown in FIGS. 1 and 2, the alignment marks 26, 28 indicate that more than sufficient torque has been applied, the cap alignment mark 26 having traveled slightly past the body alignment mark 28 for a standard right-hand threaded assembly.

If, however, excessive torque is applied and the cap 14 is overtightened on the body 12, the vial transfer assembly of the automated cytological specimen preparation system may be unable to remove the cap 14. Accordingly, proper positioning of the alignment marks 26, 28 on the body 12 and the cap 14 may be verified by measuring the torque required to remove the cap 14 from the body 12 during initial assembly of the vial 10. For example, proper positioning of the alignment marks 26, 28 may be verified when between about 15 to 25 inch-pounds of torque is required to remove the cap 14 from the body 12. The alignment marks 26, 28 may be used when manually reinstalling the cap 14 after depositing a patient cell sample in the preservative fluid to indicate, visually, that a substantially fluid-tight seal has been formed, without necessitating excessive tightening of the cap 14.

The body 12 may be manufactured from a translucent or transparent material to allow a user to see how much preservative fluid is in the vial 10. A suitable material is a polypropylene homopolymer, available from Amoco under the trade designation 4018. The sample vial cap 14 may be releasably engagable with the body 12 by mating screw threads 32, 34 and may be manufactured from a polypropylene random copolymer, available from Amoco under the trade designation 8949. These materials may be injection molded to rapidly and inexpensively produce the body 12 and the cap 14, although other suitable manufacturing processes may be utilized depending on the particular materials selected.

As discussed hereinabove, the seal 24 disposed between the body 12 and the cap 14 forms a fluid-tight seal when sufficient torque is applied to the cap 14 relative to the body 12. Sealing is important, to prevent both leakage and evaporation of the preservative solution in the vial 10. The seal 24 may be manufactured from a multicomposite material including a sufficiently thick, dense, resilient layer disposed on a vapor barrier. In one embodiment, the resilient layer is oriented toward the preservative to provide an effective seal. The seal 24 may include a synthetic olefin rubber or an elastomeric alloy co-extruded on a thin vapor barrier such as that available from Tri Seal International, Inc., located in Blauvelt, N.Y. and sold under the trade name Tri Seal SOR-171.

The seal 24 may be manufactured from any suitable material or materials which are capable of withstanding attack by the preservative solution in the vial 10. The solution may typically include an alcohol solution, such as methanol in a buffer. Due to the low viscosity and high vapor pressure of the preservative solution, as well as the very low density and high permeability of the vapor phase thereof, a high integrity, reliable seal composition is desired. Further, because preservative filled vials 10 may be stored for a year or more prior to use, and be subject to temperature extremes during transport and storage, the seal 24 should be capable of retaining its sealing characteristics and structural integrity for extended periods of time without excessive loss of fluid due to evaporation. The seal material also should not degrade and contaminate the preservative solution or sample.

As depicted in FIG. 1, the body 12 of the sample vial 10 includes fluid level indicia 20 by which a user may determine a proper amount of fluid to fill the vial 10 or that the vial is filled properly prior to addition of a patient's cells. The body 12 depicted is translucent, so that a user can see the fluid level inside the vial 10 from outside the vial 10. The fluid level indicia 20 may be a frosted annular band of a predetermined axial length disposed about a circumference of the body 12 at a predetermined axial location to indicate the acceptable fill range of the vial 10, so that a proper specimen can be prepared from the sample by the automated preparation system. Alternatively, the fluid level indicia may be a single fill line or an upper fill line and a lower fill line, in which the upper fill line indicates a maximum level to which the vial 10 should be filled, and the lower fill line indicates a minimum amount of fluid necessary to prepare a specimen from the sample.

In the embodiment depicted in FIG. 5, the cap 14 includes a first screw thread 32, and the body 12 includes a second, mating screw thread 34. The cap 14 and the body 12 are releasably engagable by means of the first and second screw threads 32, 34. In another embodiment, the cap 14 and body 12 are releasably engagable by a bayonet-style retention feature. Other structures enabling releasable engagement by the cap 14 and the body 12 will be apparent to those skilled in the art.

The body 12 may also include sample indicia 40. The indicia 40 can be used to identify a patient to whom the sample corresponds, as well as a slide prepared from the sample contained in the sample vial 10. The sample indicia 40 may be machine-readable, such as a bar code, which can be read by the automated cytological specimen preparation system. The bar code can be on a label disposed on the body 12 or, alternatively, can be integral with the body 12.

As depicted, the body 12 of the vial 10 is generally cylindrical in shape, having an outer diameter of approximately 1 and {fraction (5/16)} inches and an axial length of approximately 2 and {fraction (3/4)} inches. The cap 14 is generally cylindrical in shape, having an outer diameter of approximately 1 and {fraction (9/16)} inches and an axial length of approximately {fraction (9/16)} of an inch. The torque pattern 38 includes six equi-spaced radially disposed ribs 16, each approximately {fraction (1/8)} of an inch in height. The body 12 includes six equi-spaced circumferentially disposed anti-rotation lugs 18 disposed approximately {fraction (7/16)} of an inch from the open end of the body 12. The anti-rotation lugs 18 are approximately {fraction (1/8)} of an inch in height and {fraction (1/16)} of an inch in width. The fluid level indicia 20 is a frosted annular band with an axial length of approximately {fraction (1/4)} of an inch. The lower boundary of the band is disposed approximately {fraction (7/8)} of an inch from the closed end of the body 12 and the upper boundary is disposed approximately 1 and {fraction (1/8)} inch from the closed end of the body 12. The mating screw threads 32, 34 may have a pitch of about eight threads per inch.

Figure 6:
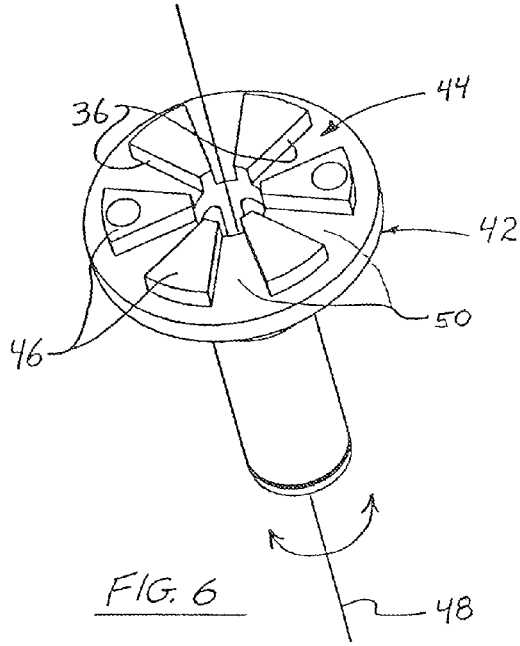
FIG. 6 is a schematic perspective view of a rotatable interface for mating with a torque pattern of the sample vial cap.

FIG. 6 is a schematic perspective view of one design of a rotatable interface 42 having a torque pattern 44 for mating with the torque pattern 38 of the sample vial cap 14. The rotatable interface 42 is shown inverted, to better depict the interface torque pattern 44 formed therein. In this embodiment, the interface torque pattern 44 includes six raised wedge-shaped sectors 46. The sectors 46 are substantially equi-spaced about the interface 42, which is rotatable about a longitudinal axis 48 thereof, and sized to mate with the torque pattern 38 of the cap 14. Accordingly, the ribs 16 of the cap 14 fit in grooves 50 formed between the sectors 46 of the interface 42 and react against substantially vertical faces 36 the sectors 46 to permit both loosening and tightening of the cap 14.

Figure 7A:
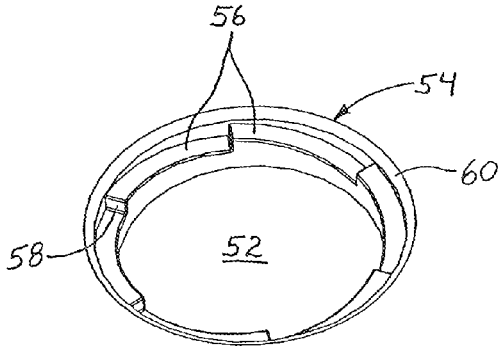
FIG. 7A is a schematic perspective view of a unidirectional interface for mating with anti-rotation features of the sample vial body.

To prevent rotation of the body 12 during these operations, the body 12 may be disposed in a sample vial tray forming a bore 52 having a unidirectional interface 54 along an edge 60 thereof for mating with the lugs 18 of the body 12, as depicted in FIG. 7A. The interface 54 includes six ramps 56, each including a substantially vertical face 58 which abuts one of the body lugs 18. Accordingly, the capped vial 10 may be disposed in the bore 52 with the flange 30 supported along the edge 60. The rotatable interface 42 may then be engaged with and tighten the cap 14, to ensure a fluid-tight seal prior to removing the vial 10 from the sample tray. Due to the orientation of the ramps 56, the lugs 18 react against the ramp faces 58 during tightening to positively secure and prevent rotation of the body 12.

Figure 7B:
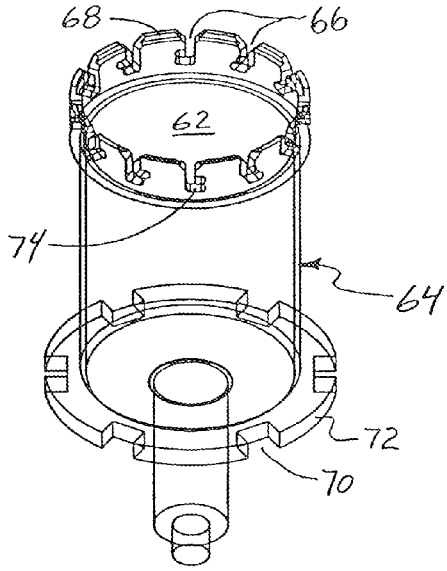
FIG. 7B is a schematic perspective view of a bi-directional interface for mating with anti-rotation features of the sample vial body.

Once the cap 14 has been tightened, the vial transfer assembly may grasp the capped vial 10 about the circumference of the cap 14, remove the vial 10 from the bore 52 in the tray, and deposit the capped vial 10 in a bore 62 formed in a vial sleeve 64, such as that depicted in FIG. 7B in wire form representation. The six lugs 18 of the capped vial 10 are received in every other one of twelve axially extending slots 66 formed along an upper edge 68 of the sleeve 64, the flange 30 of the vial 10 being supported by the edge 68. Once in the bore 62 with the lugs 18 disposed in the slots 66, the sleeve 64 may be rotated in one or both directions to disperse the cells in the preservative solution prior to uncapping the vial 10. Thereafter, a pin or other structural feature of the system may engage a notch 70 formed in a flange 72 of the sleeve 64 to prevent rotation of the sleeve and the vial 10 disposed therein while the rotatable interface 42 engages and unscrews the cap 14. The cap 14 is retracted by the vial transfer assembly and the sample collector disposed in the preservative solution in the vial 10 to collect the cells against the filter thereof and thereafter transfer the cells to a slide. Once the cytological specimen has been prepared, the cap 14 is reoriented over the open vial 10 and screwed onto the body 12 until a substantially fluid-tight seal has been formed. The axially extending slots 66 which engage the lugs 18 form a bidirectional interface, to react against the body lugs 18 during both removal and installation of the cap 14 on the body 12. Each of the axial slots 66 may be formed to include, optionally, a generally circumferentially disposed portion, shown generally at 74, to lock a suitably sized lug against axial translation, if desired.

Of course, other suitable materials, dimensions, and configurations for the body, the cap, the ribs, the lugs, the fluid level indicia, and other features of the sample vial will be apparent to those skilled in the art, those disclosed being provided as examples only. For example, while the mating ribs and sectors provide a positive, self-centering drive, other mating structure such as pins and annular tracks may be used. Further, the sample vial may be used in other applications and contain other than cytological samples in preservative solution.

Accordingly, the invention may be embodied in other specific forms without departing from the spirit or essential characteristics thereof. The foregoing embodiments are therefore to be considered in all respects illustrative rather than limiting the invention described herein. The scope of the invention is thus indicated by the appended claims, rather than by the foregoing description, and all changes which come within the meaning and range of equivalency of the claims are therefore intended to be embraced therein.

What is claimed is:

1. An automated system for manipulating a vial, the vial comprising a vial cap and a vial body, the vial body comprising a flange that extends radially around an outer surface of the vial body and at least one anti-rotation lug protruding from the outer surface of the vial body adjacent to the vial body flange, the vial cap comprising a torque pattern on an outer surface of the vial cap, the system comprising:

a vial sleeve comprising a bore sized for receiving and seating the vial body, an upper edge for interfacing with the vial body flange, and at least one axially extending slot formed in the vial sleeve upper edge and configured for receiving the at least one vial body anti-rotation lug, thereby preventing rotation of a vial body seated in the bore relative to the vial sleeve; and a controllable rotatable interface positionable by the system to engage the vial cap of the vial disposed in the vial sleeve, wherein the rotatable interface comprises an interface torque pattern configured for engaging with the vial cap torque pattern, wherein the rotatable interface and the vial sleeve are collectively controllable by the system to tighten a vial cap of a vial seated in the sleeve by applying an amount of torque to the vial cap relative to the vial body sufficient for forming a fluid-tight seal without over-tightening the cap.

2. The system of claim 1, wherein the at least one axially extending slot comprises a plurality of axially extending slots spaced circumferentially around the vial sleeve upper edge and sized for receiving a plurality of corresponding vial body anti-rotation lugs.

3. The system of claim 1, wherein the amount of torque is predetermined.

4. The system of claim 1, wherein the amount of torque is between 15 and 25 inch-pounds of torque.

5. The system of claim 1, wherein the rotatable interface torque pattern comprises a plurality of raised wedge-shaped sectors and grooves formed between the sectors, wherein each of the grooves is configured for receiving a respective rib formed on the outer surface of the vial cap.

6. The system of claim 1, wherein the rotatable interface torque pattern comprises a plurality of radially disposed grooves for receiving a corresponding plurality of radially disposed ribs on the vial cap outer surface.

7. The system of claim 1, wherein the rotatable interface torque pattern comprises a plurality of radially disposed, equidistantly spaced grooves for receiving a plurality of radially disposed, equidistantly space ribs on the vial cap outer surface.

8. The system of claim 1, wherein the sleeve is incorporated in a sample vial tray.

9. The system of claim 8, wherein the unidirectional interface comprises at least one ramp having a substantially vertical surface configured to abut the at least one vial body anti-rotation lug while the vial cap is rotated by the rotatable interface.

10. The system of claim 1, wherein a longitudinal axis of the at least one vial sleeve axially extending slot is parallel to a longitudinal axis of the vial sleeve.

11. The system of claim 1, wherein the vial sleeve upper edge is perpendicular to a longitudinal axis of the vial sleeve.

12. The system of claim 2, wherein the plurality of vial sleeve axially extending slots are equidistantly space around the vial sleeve upper edge.

* * * * *